US005238629A

United States Patent [19]

Davidson

[11] Patent Number: 5,238,629

[45] Date of Patent: Aug. 24, 1993

[54] PROCESS OF COAL AGGLOMERATION

[75] Inventor: James G. Davidson, Paris, Tenn.

[73] Assignee: Adtech, Inc. of Illinois, Marion, Ill.

[21] Appl. No.: 743,456

[22] Filed: Aug. 9, 1991

[51] Int. Cl.[5] ..... C10L 5/06

[52] U.S. Cl. ..... 264/123; 44/550; 44/556; 44/596; 264/37

[58] Field of Search ..... 264/109, 117, 123, 37; 23/314, 313 R; 44/550, 551, 556, 593, 594, 596, 599

[56] References Cited

U.S. PATENT DOCUMENTS

| | | | |
|---|---|---|---|
| 780,308 | 1/1905 | Schmidt . | |
| 2,652,318 | 9/1953 | McKee . | |
| 2,652,354 | 9/1953 | Dryden et al. . | |
| 3,327,407 | 6/1967 | Lamb et al. . | |
| 4,182,736 | 1/1980 | Gunnell | 264/117 |
| 4,219,519 | 8/1980 | Goskel | 264/82 |
| 4,224,039 | 9/1980 | Smith et al. | 44/596 |
| 4,235,603 | 11/1980 | Miller et al. | 44/550 |
| 4,294,584 | 10/1981 | Verchuur | 44/594 |
| 4,308,073 | 12/1981 | Mills . | |
| 4,323,532 | 4/1982 | Bleckmann et al. | 264/118 |
| 4,459,762 | 7/1984 | Hardesty et al. | 34/9 |
| 4,492,638 | 1/1985 | Hiratsuka et al. | 210/728 |
| 4,569,834 | 2/1986 | West et al. | 423/460 |
| 4,969,928 | 11/1990 | Wen et al. | 44/568 |

FOREIGN PATENT DOCUMENTS

| | | | |
|---|---|---|---|
| 2017434 | 5/1970 | France . | |
| 57-34197 | 2/1982 | Japan | 44/556 |
| 57-73081 | 5/1982 | Japan | 44/556 |
| 2095284 | 9/1982 | United Kingdom | 44/593 |

*Primary Examiner*—Mary L. Theisen
*Attorney, Agent, or Firm*—Waters & Morse

[57] ABSTRACT

A process for the agglomeration of coal fines comprises the steps of mixing the coal fines with an agglomerating liquid which is further comprised of a reagent and a solvent portion. The coal fines are thereafter separated from the agglomerating liquid, dried, and preferentially compressed into pellet form. The process also entails the recovery and return of the agglomerating liquid. The agglomerating liquid of the present invention includes the reagent portion which is a member or a combination of the group consisting of aromatic tertiary amines, nonaromatic cyclic amines or primary organic amines. The solvent is an organic solvent, desirably a member or a combination of the group consisting of toulene, chloroform, carbon disulfide or dimethylacetamide. The pellet formed from the process of the present invention is uniquely water resistant and of controllable hardness.

19 Claims, 1 Drawing Sheet

PROCESS OF COAL AGGLOMERATION

BACKGROUND OF THE INVENTION

The present invention relates to the field of coal processing. More specifically, the invention relates to the recovery of coal fines which are traditionally regarded as waste by-products of various coal processes or coal handling.

The generation of coal fines during the processing of coals and while coal products are being transported has long been an industry problem. The tendency for coal and related products to randomly fracture into particles has never been successfully regulated such that grinding processes result in a wide distribution of particle sizes. Similarly, the transport or handling of coals has the effect of inducing contact between larger pieces and results in the creation of fines.

The typical methods for handling these fines usually depend on systems customized for coal fines. Thus in those facilities where fines are being generated routinely, many are handled through slurry or hopper systems and are directed to settling ponds. The accumulations in these ponds are dealt with en masse. In the transport of coals, the fines will fall to the bottom of the transport container. In cases such as ship transport, the level of fines accumulating in the bottom of the hold can lead to conditions where spontaneous combustion can take place. This feature of waterborne shipments of coal has lead to sensitivity in the duration of shipments and as to the type and design of the vessel carrying the coal.

Recognition of the value of coal fines as an energy and chemical resource is long standing. The difficulty to date has been the poor economics involved in reprocessing the fines to a usable state or the lack of compatible and consistent outlets for coal fine consumption. The present invention has been successful in producing a usable coal product from coal fines while maintaining an economic advantage.

Other processes are known where coal fines are subjected to various conditions, typically high heats and/or pressure, and then are mechanically compressed or formed into pellets or briquettes. These processes are suited to low throughputs or batch operations and have energy or equipment requirements that make them unattractive for most of the situations described above.

One process is known where the coal fines are subjected to solvents that cause a partial and selective organic extraction to occur. The coal fines used in this process are preferentially those with paraffin content such that the relatively sticky compounds trapped in the coal matrix are brought to the surface of the coal particles. In this manner the particles are made to stick to each other and create clusters or clumps. Obvious drawbacks to this process include the required restriction of applying the solvents to certain coals. Most coal fines generated would not possess the requisite constituents for this process.

A need for a low cost method for the recovery and handling of coal fines has remained until the development of the present invention. As such it is at least one object of the present invention to provide a method for agglomerating coal fines as generated from many different sources. In addition, the method has significant economic advantages over past attempts in this field in that little energy input is required and much of the process chemistry is recycled.

SUMMARY OF THE INVENTION

A process for the agglomeration of coal fines comprises collecting coal fines of appropriate size, slurrying the coal fines with agglomeration reagents and solvents, and then separating and pelletizing reacted coal fines, thereby removing reagent liquor from the fines.

Specifically, coal fines with particulate size less than two hundred (200) microns are selected for treatment. They are subjected to sufficient mixing and contact with the agglomeration reagents so as to cause the desired result. The reagent liquor is comprised of reagent and solvent fractions, such that there is a 1:1 ratio generally of liquor to coal fines (milliliters to grams). The slurry thus created is utilized as vehicle for handling and reacting with the coal fines, with a small portion of the reagent being incorporated into the agglomerated coal product.

The resulting mixture of reacted coal fines and reagent liquor is further processed to efficiently separate the coal fines from the liquid fractions. The fines at this point are physically compatible with agglomeration and are susceptible to such processes under surprisingly moderate conditions. Generally, temperature is not a concern in the agglomeration process of the present invention, but, as will be discussed further, it may have significant peripheral advantages in the recycling of reagent and the preparation of a final agglomerated product.

The agglomerated coal fines of the present invention have controllable hardness qualities. Compression of the treated fines results in pellets or briquettes of various sizes, although the five-eighths (⅝) inch by one (1) inch diameter pellet has significant commercial appeal. The treated and compressed product is surprisingly resistant to water absorption and is stable over a wide temperature range.

The advantages of the present invention result from the ability to produce the desired product under conditions utilizing low energy and high reagent recovery. Typical reagent recovery is as high as ninety-nine percent (99%) and actual reagent concentration may be adjusted to affect the final product hardness. These advantages and other distinguishments of the present invention will become more apparent as the preferred embodiment is discussed below.

DESCRIPTION OF THE PREFERRED EMBODIMENT

Figure 1:
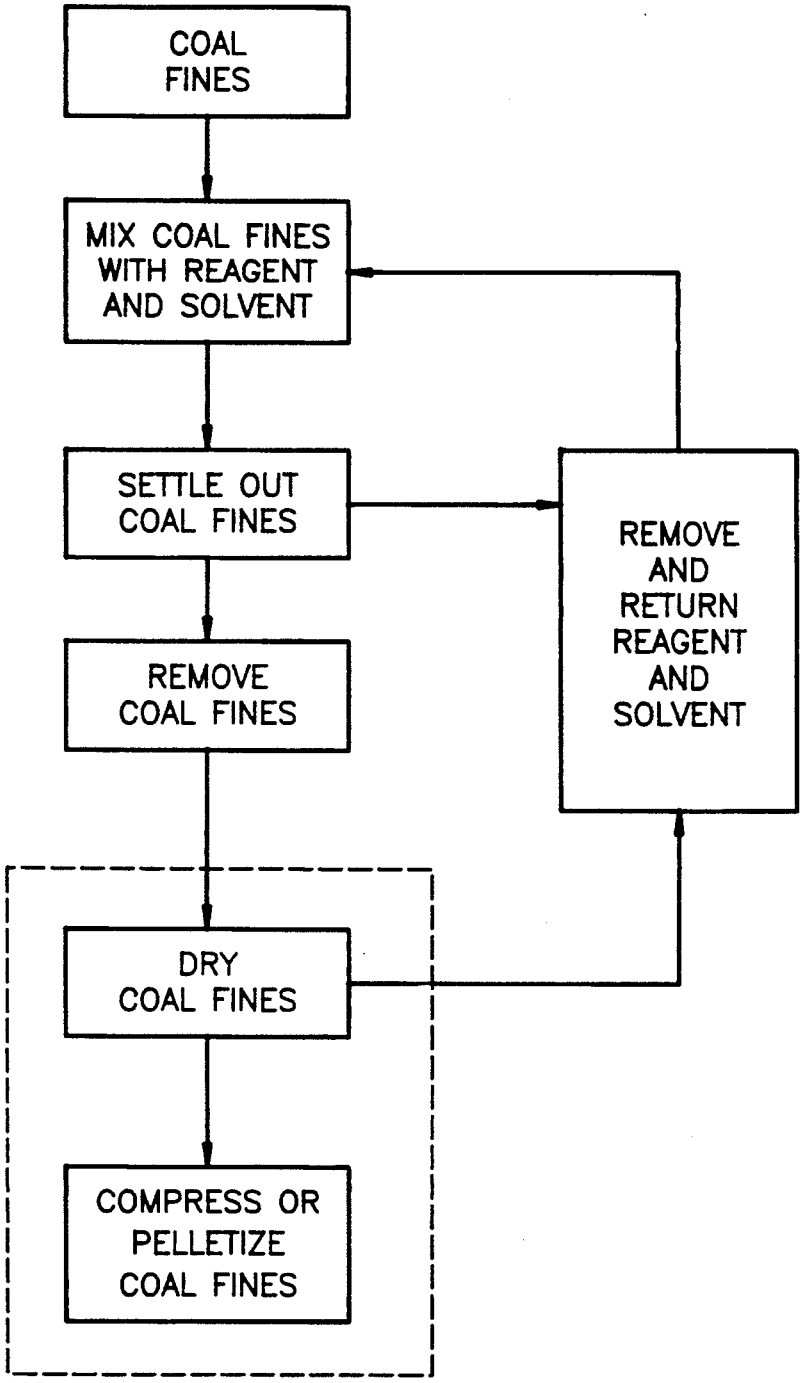
FIG. 1 is a flow chart diagram of the process of the present invention.

A process for the agglomeration of coal fines and a product deriving therefrom, according to the present invention, is described herein. The coal fines from whatever source are made susceptible to compressive treatment, such that the resulting pellets or briquettes can be utilized via standard commercial applications.

Turning now to the drawing, FIG. 1 shows the steps of the process via a flow chart diagram. Generally the steps of the process of the present invention are as shown, although it is recognized that some minor variations may exist. For example, additional chemical treatment such as a washing step may be employed, as will be discussed further, and this is not represented within the steps outlined in FIG. 1.

Other variations from the process thus outlined may be made without departing from the practice of the present invention. One skilled in the art may appreciate the possibilities of combining or adding steps to the process to effectuate a particular result. The objective of the present invention is the facilitation of developing or enhancing the agglomeration capabilities in untreated coal fines.

The coal fines utilized in the present invention may be derived from any of the three major groups of coal products or ranks. These are the bituminous, sub-bituminous and the lignite types, all of which are usually geographically segregated. The process of the present invention is applicable to all three types, although as will be discussed, the sub-bituminous coals may require additional treatments in order to achieve commercially acceptable grades of pellets or briquettes.

The source or origin of the coals notwithstanding, the generation of coal fines through many of the standard coal applications or in the handling or transport of coal will usually result in quantities of a powder looking material with poor prospects for immediate reuse. The fines are many times relegated to settling ponds where the accumulations are kept from becoming ecological disasters by virtue of submersion under water. Periodic excavation of such ponds produces large volumes of fines that for the most part, are handled as if they were hazardous waste materials. Utilizing coal fines from such sources even as this does not present a problem for the present invention.

The criterion for the coal fines to be employed in the preferred embodiment relate largely to maximum particle size and moisture content. The particle size is important since it defines the surface area being contacted by reagent, and as between the coal particles themselves. The moisture content is a factor in determining how long the process will take to complete, the occurrence of water being an inhibiting factor in the agglomeration process.

Moisture content, as indicated above, has an inhibiting effect on the agglomeration process, and coal fines with moisture content greater than twenty-two percent (22%) have significantly reduced efficiency. Since the moisture content does not impart a favorable effect, coal fines with overall moisture content substantially less than twenty-two percent (22%) would be compatible with the process of the preferred embodiment.

Moisture content in the coal fines retards the process of the present invention. This does not represent a problem normally in that insofar as the applicant has been able to determine most of the coal fines generated have less than the preferred level of twenty-two percent (22%) moisture. Tests have been run on coal fines containing as much as thirty-two to thirty-four percent (32–34%) moisture content with satisfactory, albeit delayed results.

The particle size of the coal fines is at least initially an important consideration. The process of the present invention preferentially operates with coal fines less than two hundred (200) microns in size. The distribution of particle size within any sample of coal fines will vary over a range. This variance may reflect the difference in the degree of handling or the origin of the coal fines. The fines need only be classified as to maximum size for the purposes of the present invention through means that are well known in the art and do not represent a part of the present invention. The smaller sized coal fine particles do not detract from the process; in fact it appears that the objective of sizing the coal fines relates to a requisite amount of surface area in order to initiate the reactions of the process. Particle sizes smaller than this requisite amount, may have enhanced efficiencies in terms of speed of reaction, but such advantages do not appear to be commercially distinguishable.

Coal fines have been tested specifically as low as six (6) micron particle size range. It is known in the industry particle sizes as small as six-hundredths (0.06) microns are found, although these have not specifically been tested. It is the belief of the applicant that all practical sizes of coal fines such as those being actually generated in related industries, will be susceptible to the process of the present invention at least to the extent that the particles are sized below the two hundred (200) micron level.

During the next phase of the process, the fines are mixed with the reagent chemicals. The reagent chemistry developed for this process favors a relationship whereby the reagent is a proton donor to the reactant coal fines. Various compounds have been tested in this regard, and a number of classes appear to be compatible with the process.

The class of aromatic tertiary amines appears to be the most effective of the compounds used as reagents in the process. Various members of the aromatic tertiary amines have been tested in the process of the present invention, including quinoxaline, cinnoline, quinazoline acridine, phenazine, phenanthroline, phenanthridine, quinoline and isoquinoline. Of these, the preferred reagent is quinoline, although, as will be explained, isoquinoline is actually more effective.

Other organic groups have been tested for effectiveness in the process with the result that cyclic nonaromatic amines have been found to function in the process as well. Specifically morpholine is quite effective in achieving the desired reactions of the process. In addition, tests have been conducted on various primary amines which have similarly been effective in achieving the same results.

Tests conducted using morpholine, piperazine, piperidine, pyrrolidine, and pyrrole have shown these cyclic nonaromatic amines to induce the agglomeration characteristics of the present invention. Tests conducted on various primary amines such as dipropylamine and triethylamine have also proved to be effective in the process.

The preferred compound, quinoline, is typically diluted with a selected solvent. The preferred concentration range is equivalent to two (2) mls of quinoline dissolved in eight (8) mls of solvent per ten (10) grams of coal fines. Thus the overall ratio of reagent and solvent to coal fines is 1:1 volume to weight. In terms of the handling of the coal fine and reagent slurry, this ratio seems to have some advantages. It can be seen from the nature of the process that more or less solvent may be added without impairing the basic reactions, although it may mechanically impair the completeness of the process. The ratio of reagent and solvent to coal fines may be as high as 2:1 and still be commercially attractive. Ratios higher than this would still be effective in the process but corresponding increases in equipment handling problems and wastage render these less than optimal.

Amounts less than the two (2) mls of quinoline per ten (10) grams of coal fine sample may be utilized, but the results again will impact completeness of the reaction process. It appears from analysis of the recovered products and reactants that approximately one to two percent (1-2%) of the quinoline reactant is actually consumed or lost. The lowest concentration for reacting the quinoline of the present invention with coal fines would be two-hundredths (0.02) mls per a ten (10) gram sample of coal product. Commercial feasibility at this level is unattractive since the reaction kinetics would inhibit satisfactory yields over extended periods of time. Additions greater than the two (2) mls of quinoline per ten (10) grams of coal fines would be effective but redundant in terms of maximizing the benefits of process. Since many of the aromatic and nonaromatic amines feasible for this process are quite viscous, the effects of raising concentrations much above the two (2) mls per ten (10) gram level would result in difficulty in slurrying the coal fines and reagents. As a practical limit, the usage of more than three 3 mls of quinoline would be excessive in the practice of the present invention. Adjustments in the concentration greater than 3 mls may be made if hardness of the compressed coal product is to be correspondingly increased. Further discussion of this aspect occurs within the specification. One skilled in the art would certainly appreciate the consequences of such additions and would modulate conditions to achieve the best effect possible.

The usage of isoquinoline in the present invention is more effective than the preferred quinoline. Tests have indicated that isoquinoline is four to ten percent (4-10%) more effective than quinoline. From a commercial standpoint it is difficult to acquire isoquinoline in amounts sufficient for large scale operation of the present invention. Thus, the readily available quinoline chemistry is preferred in order to achieve the stated objectives of economy.

The addition of solvent to the quinoline reagent not only has the benefit of enhancing the handling characteristics of the reagent mixture, but is believed to assist in dispersion and mixing. Additions of various solvents have observably improved the completeness of reaction between the quinoline of the preferred embodiment and the coal fines. Whether this is a function of the increased penetrability with solvent type materials or whether it relates to mechanical factors in mixing and handling, the effect is still the same in the sense that the reagents more completely interact with the reacting coal fines.

The preferred solvent is dimethylacetamide. Other solvents that have been tested and found to be effective include toluene, chloroform and carbon disulfide. The addition of solvent has the benefit of reducing the unpleasant odors associated with organic amines. In the case of the preferred reagent, quinoline, the aromatic amine odor is quite pungent and is typical of the members of its chemical family. The solvent additions for reasons not fully understood, appear to mask the amount of odor being generated by the reactant under process conditions.

The reagent chemicals of the process share many common attributes as would be expected. They are distillable and possess similar water solubility characteristics. As will be seen, these traits are useful and can be exploited in the process of the present invention to achieve recoveries and efficiencies that have prevented useful processing of coal fines in the past.

One curious aspect of the process of the preferred embodiment is that it has been found the reaction between the aromatic tertiary amines and the coal fines proceeds more efficiently in the dark. Specifically, the exclusion of visible light results in better reaction efficiencies and the recovery of viable reactants. For the purposes of the present invention, the process may be enclosed within reaction vessels, thus eliminating the exposure to visible light; or in the alternative, it may be conducted within facilities that can be darkened for the same purpose. To date, tests conducted have indicated that nominal intrusions for inspection of process wherein small amounts of visible light or select light, such as red filtered light, do not poison or spoil the process and the benefits normally achieved. The light sensitivity is related to the quinoline and isoquinoline products, since tests performed on other reactants have not indicated this same sensitivity.

The actual agglomeration process may be regulated by the usage of low weight alcohols. In particular, ethanol has been used successfully to regulate the speed of the agglomerating coal fines whether they are being vacuum dried or pelletized. The spray washing of coal fines with ethanol slows down the agglomeration process, thus allowing the development of a compact and cosmetically acceptable coal product. The actual adjustment required may depend in part on the origin of the coal fines, the particular reagent and solvent combination, and the conditions of the drying process. Given the volatile nature of the ethanol, it is not found in the resulting coal product in any significant quantity. The purging or washing of coal fines with alcohol is merely a control feature for improving the cosmetics and quality of the coal pellet, and as such does not represent a critical factor in the practice of the process.

Turning now to the post-reaction aspects of the process, the coal fines reacted with the appropriate organic amine are removed from the reaction slurry. The coal fines may be allowed to settle in a sedimentation vessel and then are drawn off for subsequent drying and compressing. The aspects of sedimentation are well known in the art and are a matter of engineering selection as to the deployment of size and type of vessels, withdrawal apparatus, and other functional attributes.

The settled coal fines, once collected, can be dried successfully by at least two processes. The first is vacuum filtration wherein the collected coal fines are presented to vacuum drying apparatus such as rotating vacuum filters. The reaction liquors are extracted from the collected coal fines and are returnable to the process.

The collected coal fines may also be dried by means of pelletizing. It has been found that by pelletizing the product of the present process under conditions of moderate temperatures, that flash volatilization of the reagent liquor takes place, leaving a pressed, dry coal fine product. The vaporized reagent liquor may be collected and returned back to the process.

Neither method of post-reaction processing should be viewed as a limitation on the process itself. The mechanical treatments involved can be scaled to compatibly receive the output of the process so as to provide a virtually continuous treatment system.

EXAMPLE I

A one hundred (100) gram of coal fines is sieved for particle size under two hundred (200) microns. The sieved fines are then added to a reagent comprising twenty (20) mls of commercial grade quinoline dissolved in eight (80) mls of dimethylacetamide. The slurry is mixed for three (3) minutes and is vacuumed filtered to remove any liquid portions as filtrate. The filter cake is allowed to air dry and results in a compact coal agglomerate product.

EXAMPLE II

A one hundred (100) gram sample of coal is treated as above, except the slurry mixture is added directly to a pelletizing device. While maintaining the temperature of a pelletizer at one hundred degrees Centigrade (100° C.), the slurry is compressed forming a pellet with an apparent density between 1.0 grams per cubic centimeter ($cm^3$) and 1.5 grams per $cm^3$. The resulting pellet has the appearance of a solid coal product and resists crumbling and dusting.

EXAMPLE III

Coal fines were sieved for particle sizes below one hundred fifty (150) microns. The fines thus collected were added to a reagent comprising ninety-eight percent (98%) m-xylene fused with two percent (2%) pyridine. The slurry is then agitated for one-half (½) minute, and then a subsequent addition of two percent (2%) by volume of toluene is added. Upon further agitation for approximately two (2) minutes, the solution is then vacuumed filtered and the filter cake is allowed to air dry. The cake produces a satisfactory agglomerate giving the appearance of a coal solid.

As can be seen from the foregoing, various methods for practicing the present invention are possible. The desired end product of the process, however, is a compressed coal product giving the appearance of a coal solid, with high integrity that is resistant to crumbling or dusting. In addition, beneficial characteristics such as low moisture content and resistance to moisture pick-up are results of the process of the present invention.

Specific testing of the pellets produced from the present invention have shown that the stability of the pellets is very high, exceeding industry expectations in most cases. Testing under extreme conditions has shown that the integrity of the pellet is maintained during exposures between minus five degrees centigrade (−5° C.) and up to seventy degree centigrade (70° C.) for days at a time. In addition the pellet integrity was maintained under the same conditions when the pellet was totally immersed in water. Testing of the immersed pellets range from one (1) hour of immersion to three (3) days or more with no loss of pellet integrity.

The hardness of the compressed product from the process of the present invention can be measured via the Hardgrove Grindability Index. The Hardgrove Index of the vacuumed filtered product ranged from 77.0 for pellets formed under twenty-three (23) inches Hg vacuum to 83.0 on the Hardgrove scale under conditions of twenty-seven (27) inches Hg vacuum. Surprisingly, the hardness of the final coal product can be adjusted by modifying the reaction conditions. Increasing the ratio of the preferred reagent quinoline to solvent will result in increasing the hardness of the pellets formed by the present process.

Agglomerated coal fines were tested for hardness under varying concentrations of reagents. At a concentration of approximately sixty percent (60%) quinoline, or six (6) mls per ten (10) grams of coal fines, a maximum hardness of product was achieved which is substantially greater than virgin coal. While this concentration of the preferred reagent is greater than the range discussed before, it is a reflection of the range of characteristics that can be developed by the process. The consequences of agglomerated coal fine pellets with hardnesses greater than coal itself mainly impacts in transport and handling.

The characteristic of water resistance of the pellets produced from this process may come about as a result of the nature of the reaction between the chemistry in the coal fines. It is believed that the final agglomerated product is a more saturated organic product than the starting material and the result of this hydrogen loading is to resist infiltration of the coal product by water. The hydrophobic characteristics of the finished product have significant commercial interest since transport of moisture laden coals adds to the cost of transport and results in difficulties especially in cold weather. The tendency for coal products to freeze together can deter the usage of coal in northern climates where the demand for cheap energy resources is most acute. In addition, the infiltration of water into coal products lowers the net BTU (British Thermal Unit) value of combustion. Eliminating or reducing the infiltration of water is a feature of the present invention that directly affects the economics and feasibility of utilizing agglomerated coal fines.

The usage of the present process on sub-bituminous coal, or "western coal", is possible by slight modification. It has been found that the iron concentration, in the form of hematite, plays at least a modest role in the agglomeration process. While hematite is naturally occurring in coals from other sources, the western coal contains little and needs to have adjustments in the hematite concentration in order to achieve maximum results under the process of the present invention.

In order to optimize the conditions for pelletizing, it has been found that additions of one percent (1%) hematite by weight results in pellets of high quality. Additions greater than this amount will still result in good quality pellets, however, the additional increase in ash content is considered undesirable. Correspondingly, less than one percent (1%) hematite additions to western coal fines reduces the pellet quality proportional. One skilled in the art could modulate additions above and below the optimal one percent (1%) range to achieve an engineered result. From a general standpoint, it would be undesirable in any event to increase the hematite concentration above five percent (5%) since the utility of the resulting pellet would be reduced to the point of making it impractical for most routes of consumption.

The inclusion of hematite in the western coal fines has been tested for any potential effects on Hardgrove Index. Testing has indicated that additions do not contribute in any significant way to increases in the Hardgrove Index, the hematite concentration apparently assisting in the agglomeration process itself by adjusting acid/-base ratios.

The usage of a pelletizer in the present process is an advantage over the vacuum or air drying of agglomerated coal fines. The pelletizing apparatus is typically constructed to operate at a temperature of approximately one hundred degrees Centigrade (100° C.) and under thirty (30) inches Hg pressure. The heat in the pelletizer head, along with the action of the pelletizing device itself, is sufficient to drive the reagent and solvent portion from the pelletizing apparatus. The volatilization of the preferred quinoline and dimethylacetamide can be controllably recovered by condensation techniques. Thus, the loss of valuable chemistry is reduced while providing a means for expeditious drying of the coal fine product.

The recovery of reagent and solvent from the pelletizer has been demonstrated to be as high as ninety-nine percent (99%). It appears that from the work done so far that the pelletizer recoveries are expected to be higher than that which may be achieved by a vacuum filtration. Since the capacity of the pelletizing operation can be adjusted to handle the volume of a continuous system, it represents the most efficient means of practicing the art of the present invention.

The quality of the pellet produced as a result of the present process can be affected by the exposure to visible light, by the water content, and by the hardness engineered for the pellet. Commercial acceptance of pelletized coal fines is primarily founded on the usage of these as a combustible material. Feedstocks for boilers and furnaces would find the pellet form most attractive, easily handled and transportable. With these factors in mind, it can be seen that the pellets of the present invention can be developed specifically for the application to achieve the desired qualities for usage in the particular application.

It can be appreciated by one skilled in the art that various and modifications on the preferred embodiment of the present invention can be practiced without straying from the spirit and scope of the present invention. The examples and preferences expressed are meant to be illustrative of the practice of the process and are not expressed as limitations thereof.

I claim:

1. A process for the agglomeration of coal fines comprising the steps of:

slurrying the coal fines with an effective amount of an agglomerating liquid comprising a reagent chemical and a solvent in which the reagent chemical is soluble, creating a slurry solution, the reagent chemical comprising one or a combination of members selected from the group consisting of aromatic tertiary amines, cyclic nonaromatic amines, and primary organic amines;

mixing and reacting the coal fines with the reagent chemical and solvent, such that the coal fines are affected by the reagent chemical and thereafter made amenable to compressible agglomeration;

removing the coal fines from the slurry solution;

drying the coal fines by removing the reagent chemical and solvent from the coal fines;

recovering and retaining the reagent chemical and solvent for reuse in the process; and compressibly agglomerating the coal fines under sufficient pressure to produce agglomeration.

2. A process for the agglomeration of coal fines as in claim 1, wherein the solvent comprises one or a combination of members selected from the group consisting of toulene, chloroform, carbon disulfide and dimethylacetamide.

3. A process for the agglomeration of coal fines as in claim 1, including the step of compressing the dried coal fines into pellet form.

4. A process for the agglomeration of coal fines as in claim 1, wherein the coal fines are dried in a pelletizer operable at conditions of sufficient temperature and pressure to evaporate the reagent chemical and solvent.

5. A process according to claim 4, wherein the pelletizer compresses the coal fines at a pressure of no more than about thirty (30) inches Hg at a temperature sufficient to remove unused reagent and solvent by evaporation.

6. A process for the agglomeration of coal fines as in claim 1, wherein the reagent comprises quinoline or isoquinoline or a combination thereof.

7. A process for the agglomeration of coal fines as in claim 6, including the step of restricting visible light from the slurry solution.

8. A process for the agglomeration of coal fines as in claim 1, wherein the agglomerating liquid is admixed in a ratio of agglomerating liquid (milliliters) to coal fines (grams) from about 1:1 to about 2:1.

9. A process for the agglomeration of coal fines as in claim 1, wherein said coal fines are derived from subbituminous coals and the process includes the step of adding hematite to the coal fines in the amount of approximately one percent (1%) to approximately five percent (5%) by weight of the coal fines.

10. A process for the agglomeration of coal fines as in claim 1, including the step of washing the coal fines with ethanol prior to drying.

11. A process according to claim 1, wherein the reagent chemical comprises one or a combination of aromatic tertiary amines selected from the group of consisting of quinoline, isoquinoline, quinoxaline, cinnoline, quinazoline acridine, phenazine, phenanthroline, and phenanthridine.

12. A process according to claim 1, wherein the reagent chemical comprises one or a combination of cyclic nonaromatic amines selected from the group consisting of morpholine, piperazine, piperidine, pyrrolidine, and pyrrole.

13. A process according to claim 1, wherein the reagent chemical comprises one or a combination of primary amines consisting of dipropylamine and triethylamine.

14. A process according to claim 1, wherein the reagent chemical comprises quinoline or isoquinoline or a combination thereof and the solvent comprises dimethylacetamide.

15. A process according claim 1, wherein the reagent chemical and solvent are mixed in the ratio of two (2) parts reagent chemical to about eight (8) parts solvent by volume and the agglomeration liquid is admixed with the coal fines in the ratio of about 1:1 (mls liquid to grams of coal fines).

16. A process according to claim 14, wherein the reagent chemical is admixed with coal fines in the ratio of about two-hundredths (0.02) mls to at least two (2) mls reagent chemical to about ten (10) grams of coal fines.

17. A process for the agglomeration of coal fines comprising the steps of:

slurrying the coal fines with an effective amount of a reagent chemical and solvent for the reagent chemical, where the reagent chemical is comprised of quinoline or isoquinoline or a combination thereof, and where visible light is substantially eliminated as a condition of the process;

mixing and reacting the coal fines with the reagent chemical and solvent under conditions such that the coal fines are affected by the reagent chemical and thereafter made amenable to compressible agglomeration;

removing the coal fines from the slurry solution by settling the coal fines in a sedimentation vessel;

removing the coal fines from the sedimentation vessel;

drying the coal fines by evaporating the reagent chemical and solvent from the coal fines;

recovering and retaining the reagent chemical and solvent from the sedimentation vessel for reuse in the process; and compressibly agglomerating the coal fines under sufficient pressure to produce agglomeration.

18. A process for the agglomeration of coal fines as in claim 17, including the step of recovering and retaining the reagent chemical and solvent evaporated from the coal fines.

19. A process for the agglomeration of coal fines comprising the steps of:

slurrying the coal fines with an effective amount of an agglomerating liquid comprising n-xylene and pyridine, creating a slurry solution;

mixing and reacting the coal fines with the agglomerating liquid in the presence of an effective amount of the solvent toluene, such that the coal fines are affected by the agglomerating liquid and thereafter made amenable to compressible agglomeration;

removing the coal fines from the slurry solution;

drying the coal fines by removing the agglomerating liquid and solvent from the coal fines;

recovering and retaining the agglomerating liquid and solvent for reuse in the process; and compressibly agglomerating the coal fines under sufficient pressure to produce agglomeration.

* * * * *